US010641534B2

(12) United States Patent
Kim et al.

(10) Patent No.: US 10,641,534 B2
(45) Date of Patent: May 5, 2020

(54) ICE SUPPLYING APPARATUS AND REFRIGERATOR HAVING THE SAME

(71) Applicant: LG ELECTRONICS INC., Seoul (KR)

(72) Inventors: Bongjun Kim, Seoul (KR); Siyeon An, Seoul (KR)

(73) Assignee: LG Electronics Inc., Seoul (KR)

( * ) Notice: Subject to any disclaimer, the term of this patent is extended or adjusted under 35 U.S.C. 154(b) by 354 days.

(21) Appl. No.: 14/927,520

(22) Filed: Oct. 30, 2015

(65) Prior Publication Data

US 2016/0138845 A1 May 19, 2016

(30) Foreign Application Priority Data

Nov. 18, 2014 (KR) ..... 10-2014-0161037

(51) Int. Cl.
*F25C 5/04* (2006.01)
*F25C 5/20* (2018.01)

(52) U.S. Cl.
CPC ..... *F25C 5/046* (2013.01); *F25C 5/22* (2018.01); *F25C 2400/04* (2013.01); *F25C 2500/02* (2013.01); *F25C 2500/08* (2013.01)

(58) Field of Classification Search
CPC .. F25C 5/002; F25C 5/005; F25C 5/02; F25C 5/12; F25C 5/046; F25C 2400/04; F25C 2500/08; F25C 5/04; F25C 5/24; F25C 5/22; F25C 2500/02
See application file for complete search history.

(56) References Cited

U.S. PATENT DOCUMENTS

| | | | | |
|---|---|---|---|---|
| 2,645,910 A * | 7/1953 | Leeson | F25C 5/046 62/71 |
| 7,571,619 B2 * | 8/2009 | Park | F25C 5/005 62/320 |
| 2008/0134709 A1 * | 6/2008 | Fischer | F25C 5/005 62/344 |
| 2010/0313595 A1 * | 12/2010 | Seo | F25C 5/005 62/344 |
| 2011/0146312 A1 * | 6/2011 | Hong | F25C 1/04 62/137 |

FOREIGN PATENT DOCUMENTS

| | | |
|---|---|---|
| KR | 20-1999-0038736 | 10/1999 |
| KR | 10-2007-0076751 | 7/2007 |
| KR | 10-0854826 | 8/2008 |

OTHER PUBLICATIONS

Office Action issued in Korean Application No. 10-2014-0161037 on Oct. 28, 2015, 10 pages (with English translation.

* cited by examiner

*Primary Examiner* — Jianying C Atkisson
*Assistant Examiner* — Tavia Sullens
(74) *Attorney, Agent, or Firm* — Fish & Richardson P.C.

(57) ABSTRACT

An ice supplying apparatus includes: an ice bank configured to store therein ice made by an ice maker; a blade unit having a fixed blade, and a rotary blade formed to be relatively-rotatable with respect to the fixed blade, the rotary blade configured to crush ice when rotated in one direction; and a discharge guide unit provided below the blade unit, and configured to discharge the crushed ice, wherein a scattering preventing unit having a different inclination, in a gravitational direction of the earth, from another side of the discharge guide unit is formed at one side of the discharge guide unit, so as to prevent scattering of the crushed ice when the crushed ice is taken out.

17 Claims, 9 Drawing Sheets

ICE SUPPLYING APPARATUS AND REFRIGERATOR HAVING THE SAME

CROSS-REFERENCE TO RELATED APPLICATION

Pursuant to 35 U.S.C. § 119(a), this application claims the benefit of earlier filing date and right of priority to Korean Application No. 10-2014-0161037, filed on Nov. 18, 2014, the content of which is incorporated by reference herein in its entirety.

BACKGROUND OF THE INVENTION

1. Field of the Invention

The present invention relates to an ice supplying apparatus capable of supplying ice formed by an ice maker, and a refrigerator having the same.

2. Background of the Invention

An ice maker is an apparatus for generating ice by removing heat from water. The ice maker is configured to make ice by cooling supplied water (ice making water), to separate the made ice, and to automatically store the separated ice.

Such an ice maker is implemented in various manners. For instance, the ice maker may be applied to a beverage device for providing cool beverage in facility such as a café or a fast food store, or may be mounted in a general refrigerator having a refrigerating/freezing function so that a user can directly take out ice by using an additional function. Alternatively, the ice maker may be mounted to a water purifier for purifying water by passing raw water through a filter.

Ice made by the ice maker is supplied to a user through an ice supplying apparatus. An ice discharge mode using the ice supplying apparatus includes a carved ice mode for discharging carved ice in a crushed manner. In the carved ice mode, part of crushed ice may scatter to the periphery of a cup.

In order to prevent such scattering of crushed ice, research is being actively ongoing for an enhanced structure of the ice supplying apparatus. For instance, Korean Laid-Open Patent Publication No. 10-2001-0026389 (2001 Apr. 6) discloses a structure to reduce the amount of ice scattered, by adding a cover fixing unit for preventing movement of a scattering preventing cover.

However, the technique has a limitation in substantially reducing the amount of ice scattered, because a structure for preventing movement of a discharge guide unit is added to the conventional structure, without differently designing a discharge structure with consideration of an ice scattering direction.

Further, the amount of ice scattered becomes greatly different according to a position, a length, etc. of a discharge guide unit. Besides, since a size of the discharge guide unit is determined based on a size of ice cubes, the size of the discharge guide unit is increased when the size of the ice cubes is large. This may cause a limitation in reducing the amount of ice scattered.

SUMMARY OF THE INVENTION

Therefore, an aspect of the detailed description is to provide an ice supplying apparatus capable of preventing crushed ice from scattering to the periphery of a vessel when the crushed ice is taken out, and a refrigerator having the same.

To achieve these and other advantages and in accordance with the purpose of this specification, as embodied and broadly described herein, there is provided an ice supplying apparatus, including: an ice bank configured to store therein ice made by an ice maker; a blade unit having a fixed blade, and a rotary blade formed to be relatively-rotatable with respect to the fixed blade, the rotary blade configured to crush ice when rotated in one direction; and a discharge guide unit provided below the blade unit, and configured to discharge the crushed ice, wherein a scattering preventing unit having a different inclination, in a gravitational direction of the earth, from another side of the discharge guide unit is formed at one side of the discharge guide unit, so as to prevent scattering of the crushed ice when the crushed ice is taken out.

In an embodiment of the present invention, the fixed blade and the scattering preventing unit may be disposed on opposite sides based on an arbitrary line extending from a rotation axis of the rotary blade in a gravitational direction of the earth.

In an embodiment of the present invention, the scattering preventing unit may be positioned between a tangential vector and a normal vector at a lowest point of a circle formed as the rotary blade is rotated in one direction.

In another embodiment of the present invention, the discharge guide unit may include a guide body installed at a dispenser case, and having an inlet through which the crushed ice is introduced; and an inner guide formed in the guide body, configured to guide discharge of the crushed ice, and having a discharge opening for discharge of the crushed ice. The scattering preventing unit may be formed on one side of an inner wall of the inner guide.

The scattering preventing unit may be formed such that its thickness is gradually increased toward inside of the inner guide, as it is closer to the discharge opening.

The one side of the inner wall of the inner guide may be bent to extend toward the inside on one point, thereby forming the scattering preventing unit. Both side walls of the inner guide may have the same thickness.

A distance from a central axis of the inlet to one side of the discharge opening where the scattering preventing unit is formed, may be shorter than a distance from the central axis of the inlet to another side of the discharge opening.

The ice supplying apparatus may further include a manipulation lever configured to generate a control signal for taking out ice when pressed. The inner guide may be formed to have an arc shape such that its both ends are positioned in correspondence to both sides of the manipulation lever.

The inner guide may be formed such that its thickness is gradually increased toward the inside, toward one end from one point between its both ends, thereby forming the scattering preventing unit. In this case, the one end of the inner guide may have a tapered shape so as to be distant from the manipulation lever.

In another embodiment of the present invention, an ice duct configured to guide discharge of the ice may be provided between the ice bank and the discharge guide unit.

In another embodiment of the present invention, knife edges for crushing ice may be formed at one sides of the fixed blade and the rotary blade. The knife edge of the rotary blade may be configured to be moved toward the knife edge of the fixed blade, when the rotary blade is rotated in the one direction.

When the rotary blade is rotated in the one direction, the knife edge of one side of the rotary blade may be moved toward the knife edge of one side of the fixed blade, so as to crush ice disposed between the rotary blade and the fixed blade. When the rotary blade is rotated in another direction, another smooth side of the rotary blade may push ice such that the ice is discharged in the form of ice cubes.

To achieve these and other advantages and in accordance with the purpose of this specification, as embodied and broadly described herein, there is also provided a refrigerator, including: a refrigerator body; a refrigerator door rotatably connected to the refrigerator body; and the ice supplying apparatus installed at the refrigerator door.

The present invention can have the following advantages.

Firstly, the scattering preventing unit, which has a different inclination from another side of the discharge guide unit, may be formed at one side of the discharge guide unit, with consideration of a moving direction of ice crushed by the blade unit. Owing to the scattering preventing unit, scattering of crushed ice to one side of the discharge guide unit in a biased manner can be prevented.

Secondly, a new structure is not added to the ice supplying unit, but a shape of the discharge guide unit is changed with consideration of a scattering direction of crushed ice. This can provide a scattering preventing effect, by merely replacing the existing discharge guide unit by the discharge guide unit of the present invention. The present invention is advantageous in the aspect of applicability of the product.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Hereinafter, an example where an ice supplying apparatus of the present invention is provided at a refrigerator, will be explained. However, the ice supplying apparatus of the present invention may not be limited to a refrigerator. That is, the ice supplying apparatus of the present invention may be applied to various apparatuses for supplying ice, such as a beverage apparatus and a water purifier.

Figure 1:
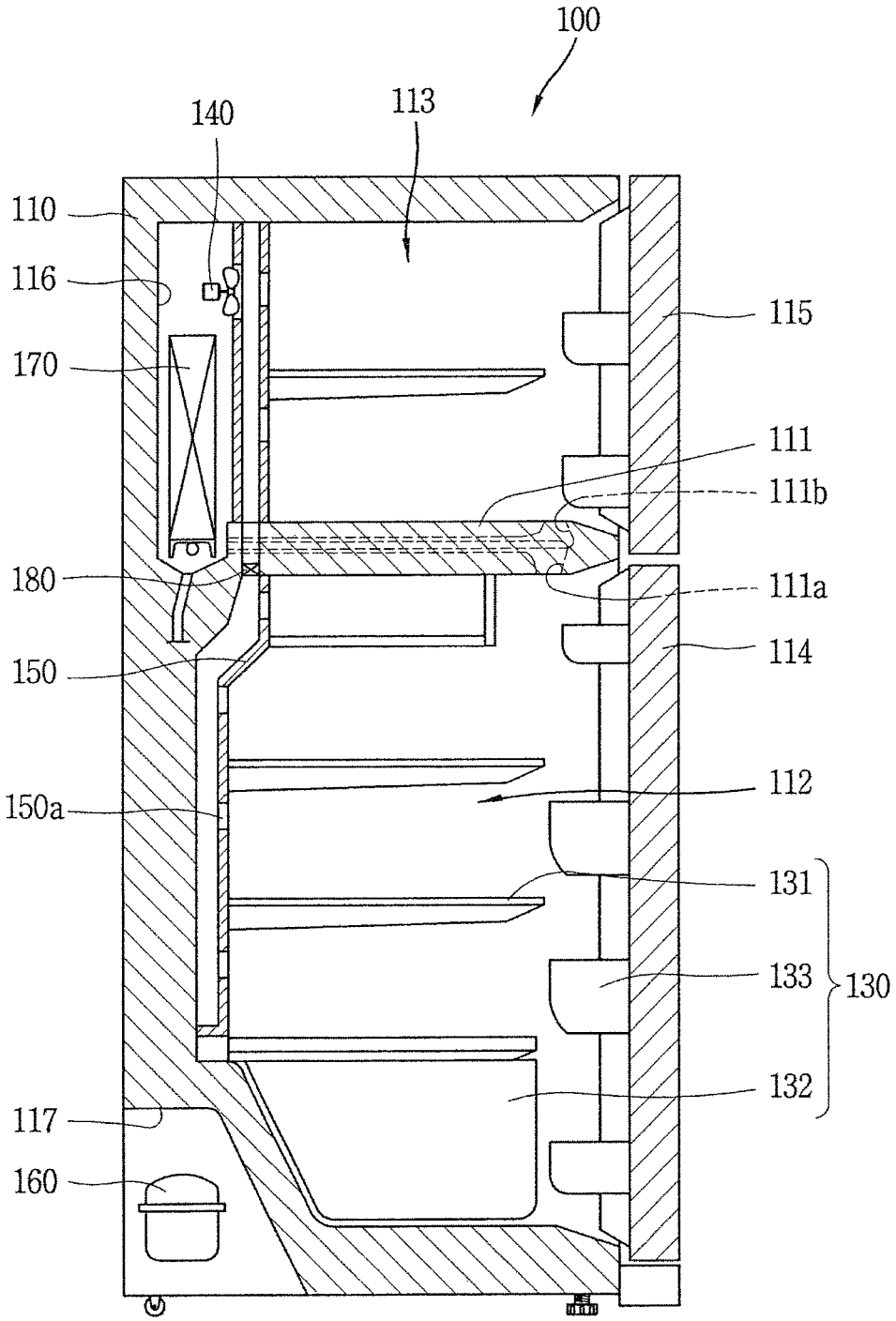
FIG. 1 is a longitudinal sectional view schematically illustrating a configuration of a refrigerator according to an embodiment of the present invention.

FIG. 1 is a longitudinal sectional view schematically illustrating a configuration of a refrigerator according to an embodiment of the present invention.

The refrigerator 100 refers to an apparatus to store food items stored therein at a low temperature, by using cool air generated by a refrigerating cycle for executing compression, condensation, expansion and evaporation processes in a consecutive manner.

As shown, a refrigerator body 110 is provided with therein a storage space for storing food items. The storage space may be divided by a partition wall 111, and may be divided into a refrigerating chamber 112 and a freezing chamber 113 according to a set temperature.

The refrigerator shown in this embodiment is a top mount type refrigerator where the freezing chamber 113 is disposed above the refrigerating chamber 112. However, the present invention is not limited to this. That is, the present invention may be also applicable to a side by side type refrigerator where a refrigerating chamber and a freezing chamber are disposed right and left, a bottom freezer type refrigerator where a refrigerating chamber is disposed above a freezing chamber, etc.

The refrigerator body 110, to which a door is connected, is configured to open and close an opening formed on a front surface thereof. In the drawing, a refrigerating chamber door 114 and a freezing chamber door 115 are configured to open and close front surfaces of the refrigerating chamber 112 and the freezing chamber 113, respectively. The door may be implemented variously. For instance, the door may be implemented as a rotation type door rotatably connected to the refrigerator body 110, a drawer type door slidably connected to the refrigerator body 110, etc.

The refrigerator body 110 is provided with at least one accommodation unit 130 (e.g., a shelf 131, a tray 132, a basket 133, etc.) for efficient utilization of its inner storage space. For instance, the shelf 131 and the tray 132 may be installed in the refrigerator body 110, and the basket 133 may be installed at an inner side of the door connected to the refrigerator body 110.

A machine chamber 117 may be provided at a lower region of a rear surface of the refrigerator body 110, and a compressor 160, a condenser (not shown), etc. are provided in the machine chamber 117.

A cooling chamber 116 provided with an evaporator 170 and a blower 140 is disposed at a rear side of the freezing chamber 113. The partition wall 111 is provided with a refrigerating chamber return duct 111*a* and a freezing chamber return duct 111*b* configured to suck air inside the refrigerating chamber 112 and the freezing chamber 113 and return the air to the cooling chamber 116.

The air inside the refrigerating chamber 112 and the freezing chamber 113 is sucked to the cooling chamber 116 by the blower 140 of the cooling chamber 116, via the refrigerating chamber return duct 111*a* and the freezing chamber return duct 111*b* of the partition wall 111. The air is heat-exchanged with the evaporator 170. Then, the air is discharged to the refrigerating chamber 112 and the freezing chamber 113 through a cool air discharge opening 150*a* of a cool air duct 150. Such processes are repeatedly performed.

A cool air path communicated with the freezing chamber 113 may be provided at a rear side of the refrigerating chamber 112. In this embodiment, the cool air duct 150 having a plurality of cool air discharge openings 150*a* on a front surface thereof is installed at a rear side of the refrigerating chamber 112. A damper 180 is installed at the cool air path such that a flow of cool air introduced into the refrigerating chamber 112 is controlled.

As a user's taste becomes various and dietary life is changed, the refrigerator 100 becomes large and multi-function. Recently, a dispenser, configured to take out purified water or ice without opening a refrigerator door, is being much applied to a refrigerator.

Hereinafter, such a dispenser will be explained in more detail.

Figure 2:
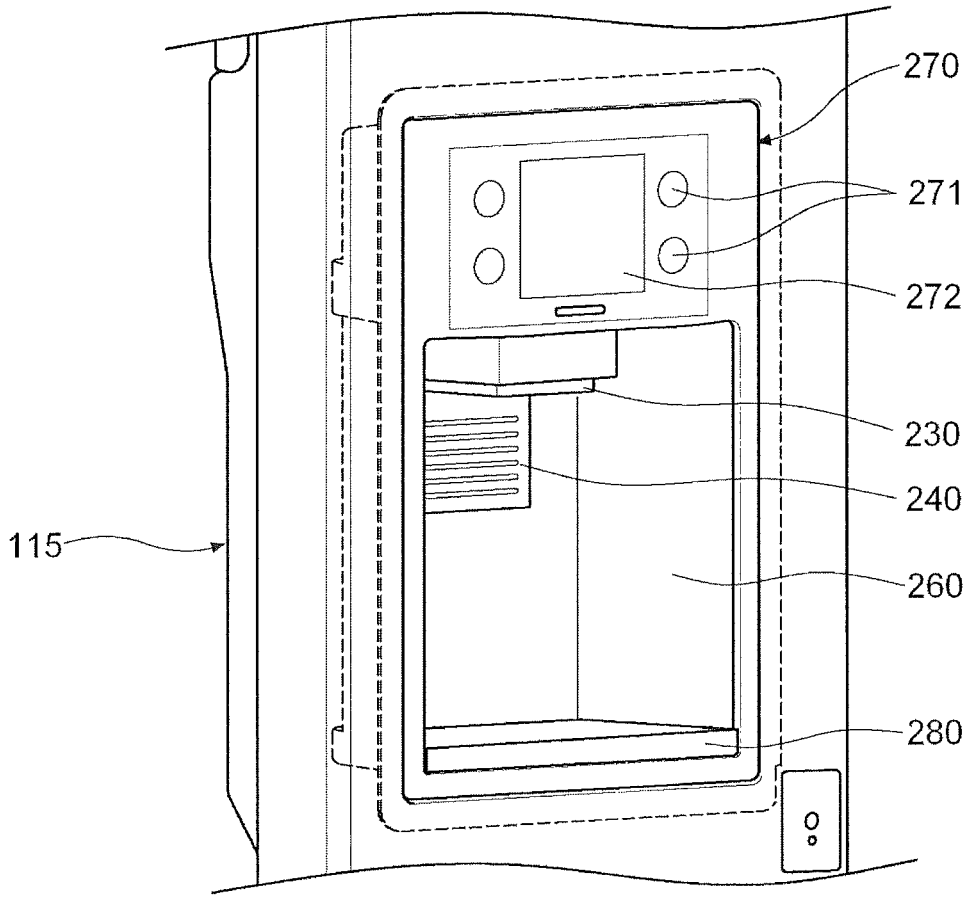
FIG. 2 is a perspective view illustrating a dispenser provided at a refrigerator door of FIG. 1.
Figure 3:
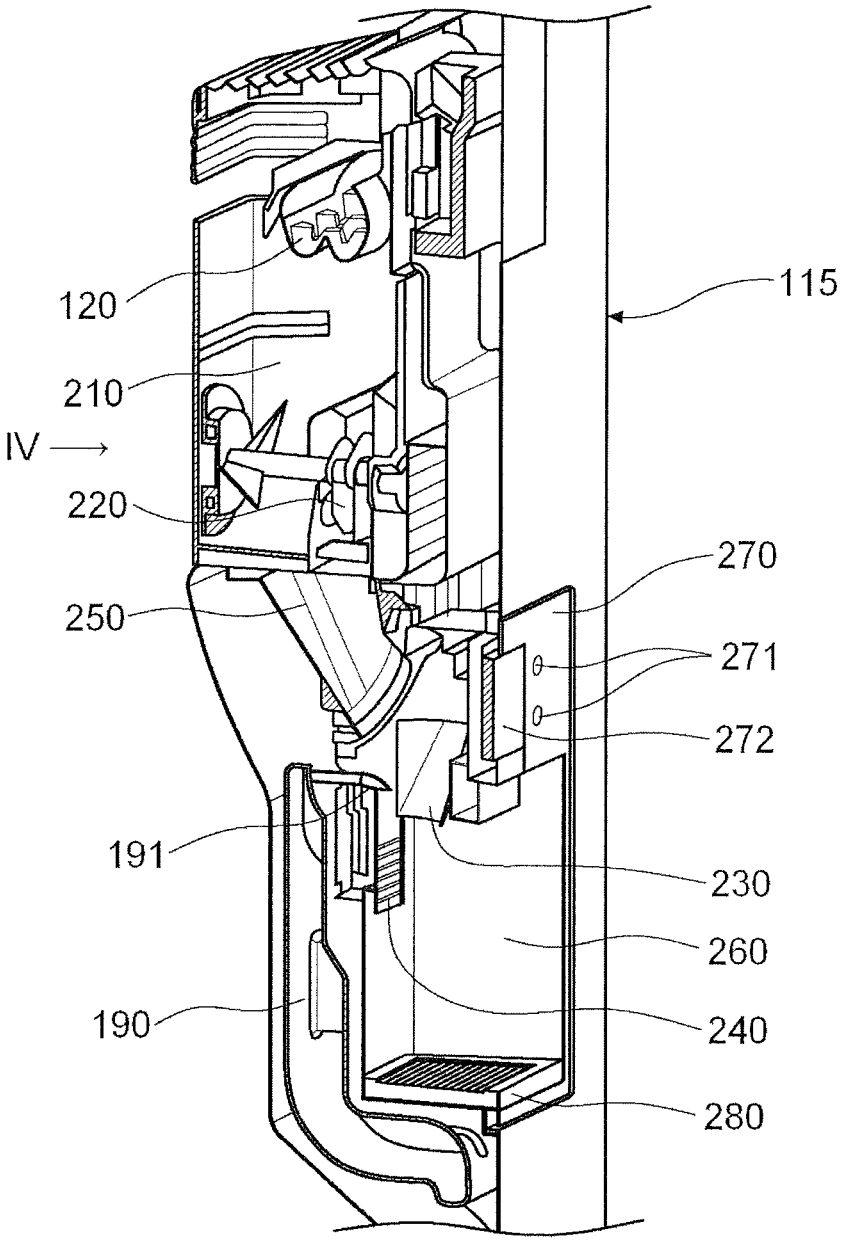
FIG. 3 is a conceptual view illustrating an inner structure of the dispenser of FIG. 2.

FIG. 2 is a perspective view illustrating a dispenser provided at a refrigerator door of FIG. 1, and FIG. 3 is a conceptual view illustrating an inner structure of the dispenser of FIG. 2.

Referring to FIGS. 2 and 3, the dispenser is formed on a front surface of the refrigerator door in an exposed manner, and is configured to allow a user to take out purified water or ice without opening the refrigerator door. In this embodiment, the dispenser is provided on the front surface of the freezing chamber door 115.

A mounting structure of the dispenser will be explained in more detail.

A dispenser case 260, formed to have a shape corresponding to an inner shape of a dispenser mounting unit and forming a basic frame of the dispenser, is mounted to the dispenser mounting unit concaved toward the inside of the refrigerator door.

The dispenser case 260 may be provided with a display panel 270. The display panel 270 may include a manipulation unit 271 configured to control the refrigerator 100 and the dispenser, and a display 272 configured to output a control screen of the refrigerator 100 and the dispenser manipulated by the manipulation unit 271.

The dispenser case 260 is provided with a discharge guide 230 configured to guide discharge of ice made by an ice maker 120 such that a user takes out the ice easily.

A manipulation lever 240, configured to generate a control signal for taking out purified water or ice when pressed, is provided at a rear side of the discharge guide unit 230. For instance, if a user puts a vessel such as a cup and a bowl below the discharge guide unit 230 so as to take out ice or purified water through the discharge guide 230, and then presses the manipulation lever 240 using the vessel, purified water or ice starts to be discharged. The discharge of the purified water or ice is continuously performed when the manipulation lever 240 is in a pressed state, but is stopped when the pressed state of the manipulation lever 240 is released.

For this, the refrigerator door is provided with the ice supplying apparatus configured to store ice made by the ice maker 120 in an ice bank 210 disposed at an upper side, and then to supply the stored ice to the discharge guide unit 230 through an ice duct 250 according to an operation state of the manipulation lever 240.

The ice supplying apparatus is also configured such that purified water is supplied through a water supply duct 190 along a rear direction of the dispenser, and the supplied water is discharged through a water supply hose 191 according to a pressed state of the manipulation lever 240.

A supporting plate 280, which forms a bottom surface on which a vessel is placed, is provided on a bottom surface of the dispenser case 260. The supporting plate 280 may be configured such that water which has dropped from the discharge guide unit 230 is collected to be discharged out along a predetermined path.

A discharge mode for discharging water or ice may be selected by the manipulation unit 271 of the display panel 270. A discharge mode for ice may include an ice cube mode for discharging ice cubes, and a carved ice mode for discharging carved ice by crushing ice cubes. As aforementioned, in case of the carved ice mode, part of crushed ice may scatter to the periphery of a cup.

Hereinafter, will be explained an ice supplying apparatus capable of preventing ice crushed after being made by the ice maker 120 from scattering to the periphery of a cup.

Figure 4:
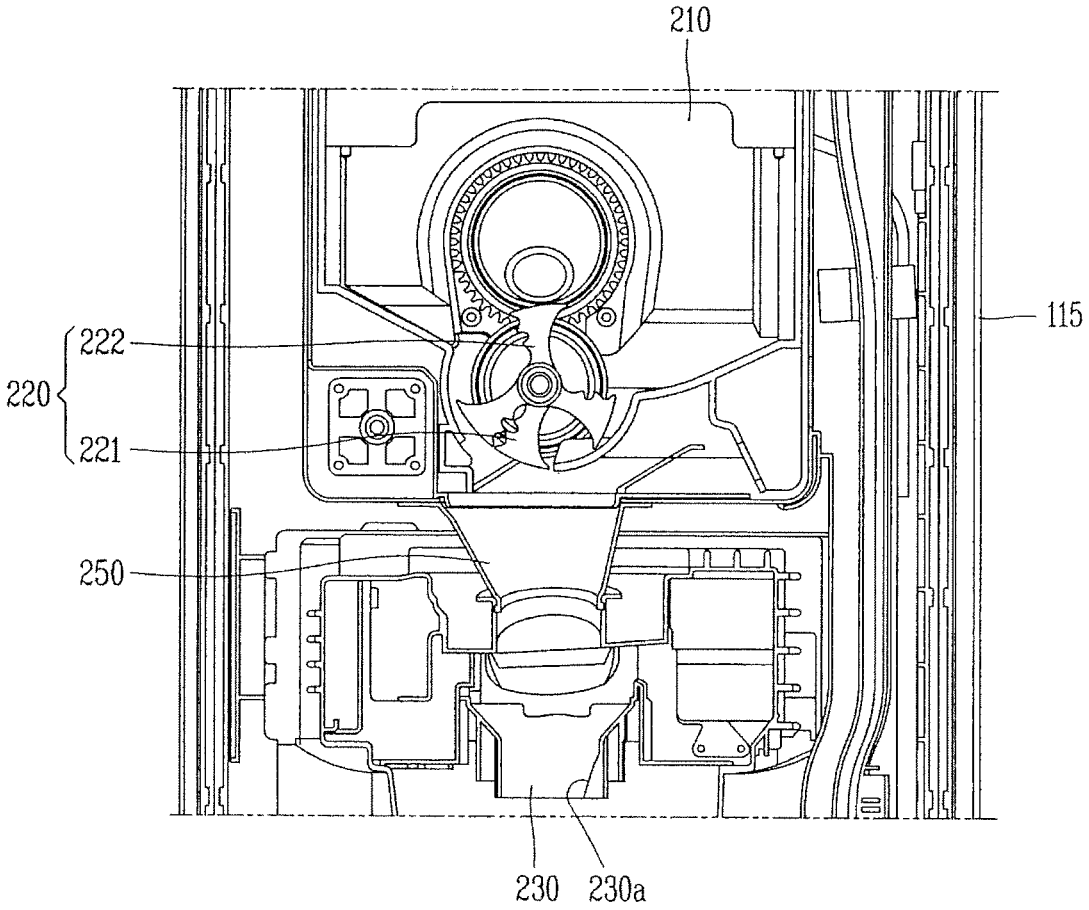
FIG. 4 is a view illustrating the dispenser of FIG. 3 seen from a direction 'IV'.

FIG. 4 is a view illustrating the dispenser of FIG. 3 seen from a direction 'IV'.

Referring to FIG. 4, the ice supplying apparatus is configured to discharge ice made by the ice maker 120, and includes an ice bank 210, a blade unit 220 and a discharge guide unit 230.

The ice bank 210 is provided below the ice maker 120, and is configured to store therein ice made by the ice maker 120. The ice bank 210 may be provided with an auger configured to transfer part of the ice stored therein according to an operation state of the manipulation lever 240.

The blade unit 220 includes a fixed blade 221, and a rotary blade 222 formed to be relatively-rotatable with respect to the fixed blade 221. The blade unit 220 is configured to discharge the ice stored in the ice bank 210 in the form of ice cubes or crushed carved ice, according to a rotation direction of the rotary blade 222. Knife edges 221*a* and 222*a* for crushing ice may be formed at one sides of the fixed blade 221 and the rotary blade 222. In this case, another side of the rotary blade 222 may be formed to be smoother than the one side.

More specifically, the rotary blade 222 is configured to be rotated in both directions. When the rotary blade 222 is rotated in one direction, ice is discharged after being crushed by the rotary blade 222 and the fixed blade 221. In this case, the one direction means a rotation direction of the rotary blade 222 by which the knife edge 221*a* of the fixed blade 221 faces the knife edge 222*a* of the rotary blade 222.

On the contrary, when the rotary blade 222 is rotated in an opposite direction to the one direction, another smooth side of the rotary blade 222 is formed to discharge ice in the form of ice cubes in a pushing manner.

The discharge guide unit 230 is provided below the blade unit 220, and is configured to discharge crushed ice finally. The discharge guide unit 230 may be formed to have a funnel shape of which sectional area is narrowed from the upside to the downside. For reference, the discharge guide unit 230 may be also called a 'chute' to those skilled in the art.

As aforementioned, once the rotary blade 222 is rotated in one direction, ice is crushed. The crushed ice is discharged not in a uniform manner right and left based on a central axis of the discharge guide unit 230, but in a biased manner to one side.

In order to solve such a problem, a discharge opening of the discharge guide unit 230 is formed such that right and left sides thereof are asymmetrical with each other based on the central axis. That is, a scattering preventing unit 230*a* is formed at one side of the discharge guide unit 230. The scattering preventing unit 230*a* is formed to have a different inclination from another side of the discharge guide unit 230, in a gravitational direction of the earth. The scattering preventing unit 230*a* is configured to prevent scattering of crushed ice discharged in a biased manner to one side.

Figure 5:
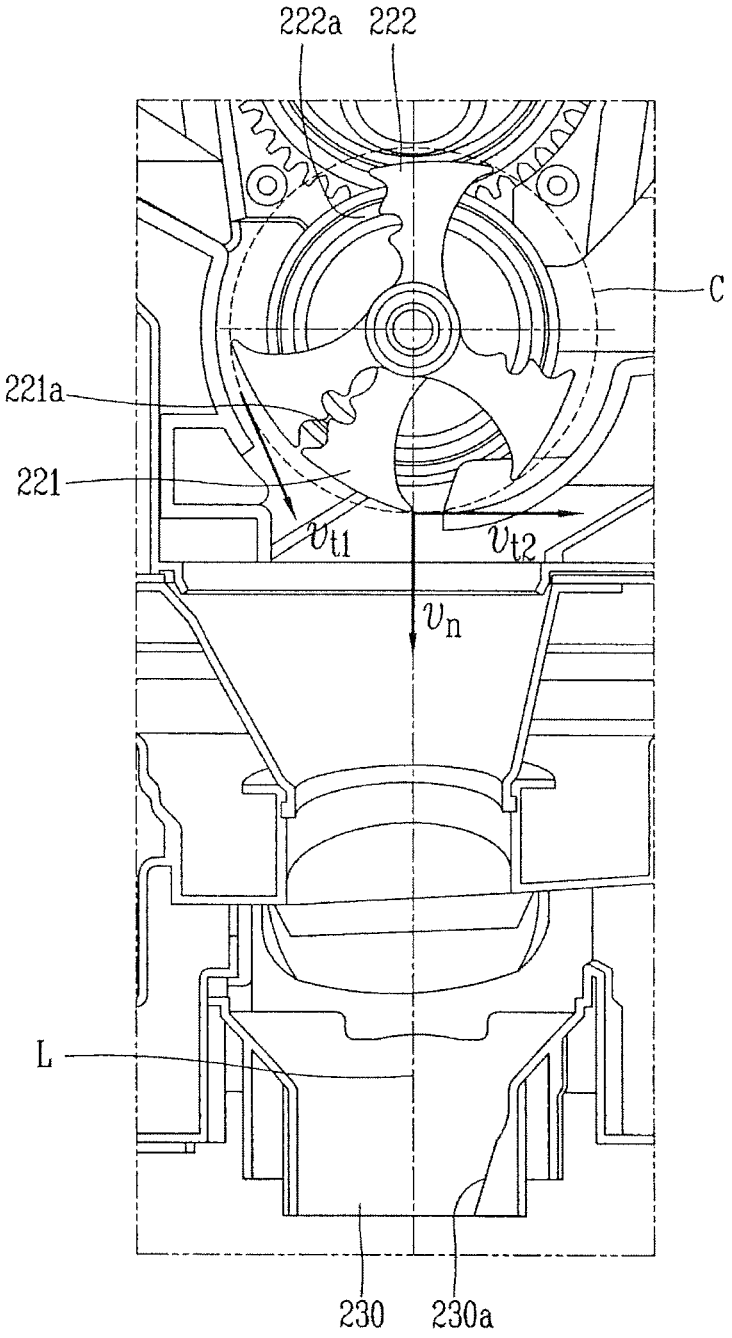
FIG. 5 is a conceptual view illustrating a position relation between a blade unit and a scattering preventing unit of FIG. 4.

Hereinafter, the scattering preventing unit 230*a* will be explained in more detail. FIG. 5 is a conceptual view illustrating a position relation between the blade unit 220 and the scattering preventing unit 230*a* of FIG. 4.

Referring to FIG. 5, a formation position of the scattering preventing unit 230*a* is related to a moving direction of ice which has been crushed by the blade unit 220.

Ice crushing occurs when the rotary blade 222 is rotated in one direction so as to face the fixed blade 221, and a large amount of crushed ice is moved to a lower side in a biased manner, by a rotational force of the rotary blade 222. The lower side indicates a region that a tangential vector (vt1) of a circle (C) formed by the rotary blade 222 which is crushing ice faces. Thus, the scattering preventing unit 230*a* is formed at a region of the discharge guide unit 230 in correspondence to the lower side, so as to block the lower side where a large amount of crushed ice is moved.

Considering only a rotation direction of the rotary blade 222, the scattering preventing unit 230*a* is positioned between a tangential vector (vt2) and a normal vector (vn) on a lowest point of a circle (C) formed as the rotary blade 222 is rotated in one direction for crushing ice. The aforementioned lower side is positioned between the tangential vector (vt2) and the normal vector (vn).

A position where ice crushing occurs is related to a position of the fixed blade 221. Accordingly, a formation position of the scattering preventing unit 230*a* is determined based on a position of the fixed blade 221, and a rotation direction of the rotary blade 222 for crushing ice. The formation position of the scattering preventing unit 230*a* may be determined as follows.

More specifically, the fixed blade 221 and the scattering preventing unit 230*a* are disposed on opposite sides based on an arbitrary line (L) extending from a rotation axis of the rotary blade 222 in a gravitational direction of the earth. In the drawings, the fixed blade 221 is positioned on the left side, and the scattering preventing unit 230*a* is positioned on the right side.

Hereinafter, a detailed structure of the discharge guide unit 230 having the scattering preventing unit 230*a* will be explained.

Figure 6:
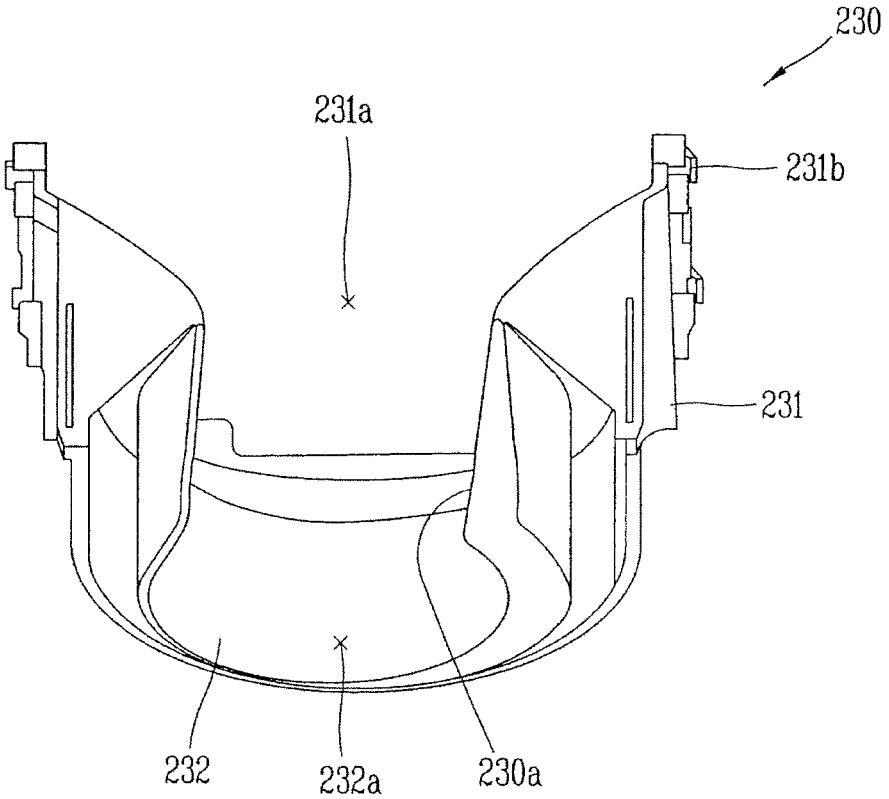
FIGS. 6 to 8 are conceptual views of a discharge guide unit of FIG. 5, which are seen from different directions.
Figure 7:
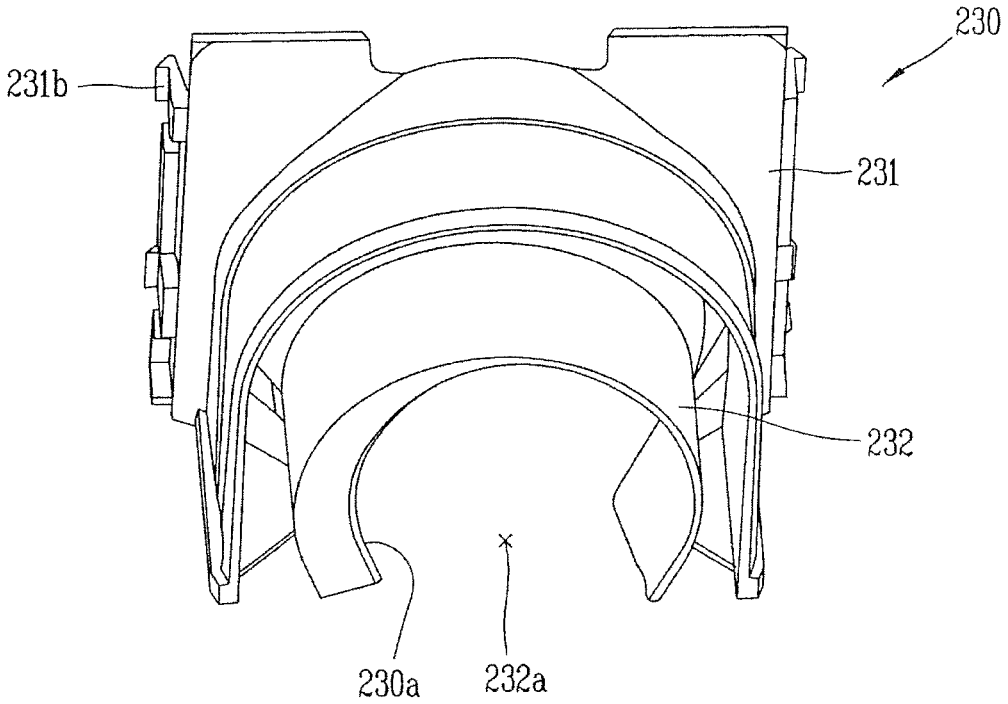
Figure 8:
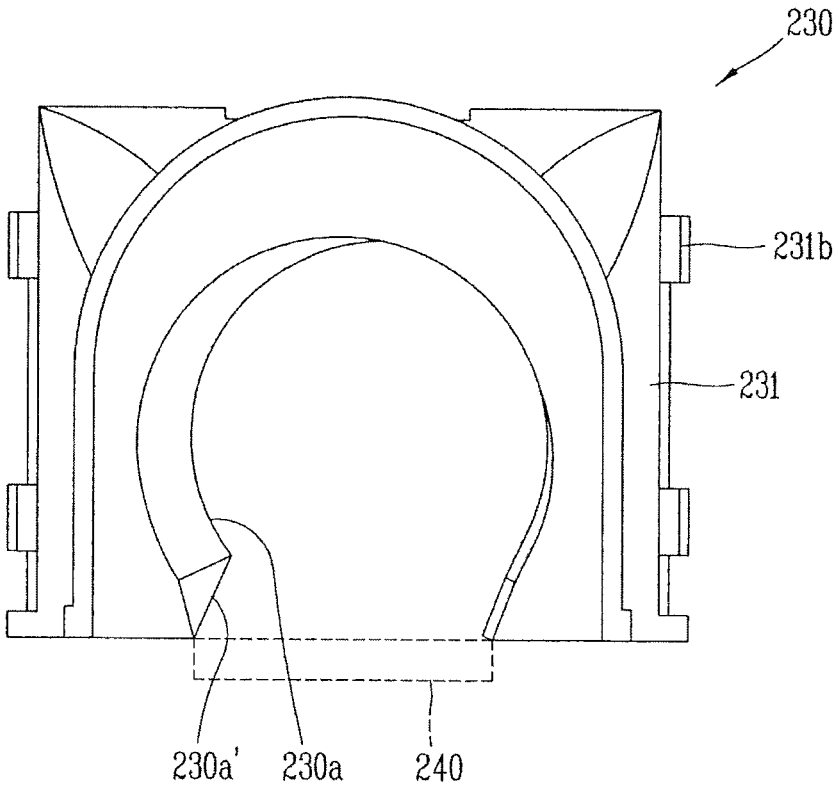

FIGS. 6 to 8 are conceptual views of the discharge guide unit 230 of FIG. 5, which are seen from different directions.

Referring to FIGS. 6 to 8, the discharge guide unit 230 includes a guide body 231 and an inner guide 232, and the inside of the guide body 231 and the inner guide 232 is formed to have a funnel shape.

The guide body 231 is mounted to the dispenser case 260, and is provided with an inlet 231*a* through which crushed ice is introduced. As an example of a structure to mount the discharge guide unit 230 to the dispenser guide 260, the guide body 231 is provided with hooks 231*b* protruding from a plurality of regions on an edge of the guide body 231. Although not shown, the dispenser case 260 is provided with coupling grooves corresponding to the hooks 231*b*. With such a structure, once the hooks 231*b* are fitted into the coupling grooves, the discharge guide unit 230 is stably mounted to the dispenser case 260.

An inner guide 232 is formed in the guide body 231, and is configured to guide discharge of crushed ice. The inner guide 232 is communicated with the inlet 231*a* of the guide body 231, and is provided with a discharge opening 232*a* for discharge of crushed ice. The inner guide 232 may be formed to have a circular shape, or an arc shape that a rear side where the manipulation lever 240 is arranged is open.

The aforementioned scattering preventing unit 230*a* may be formed on one side of an inner wall of the inner guide 232. That is, the one side of the inner wall of the inner guide 232 is formed to have a different inclination from another side of the inner wall in a gravitational direction of the earth. In order to prevent lamination of crushed ice, the one side of the inner wall of the inner guide 232, which forms the scattering preventing unit 230*a*, is preferably formed to be smooth.

The scattering preventing unit 230*a* may be formed such that its thickness is gradually increased toward the inside of the inner guide 232, as it is closer to the discharge opening 232*a*. In the drawings, the scattering preventing unit 230*a* is formed such that its thickness is gradually increased from the upper side where the one side of the inner wall of the inner guide 232 is communicated with the inlet 231*a*, to the lower side, the discharge opening 232*a*. With such a structure, one side of the inner wall of the inner guide 232 where the scattering preventing unit 230*a* is formed, has a larger thickness than another side of the inner wall. The scattering preventing unit 230*a* may be formed such that its thickness is gradually increased toward one side from a middle region of the inner guide 232. In this case, the inner guide 232 has a maximized thickness at one end.

With such a structure, the inner guide 232 has an asymmetric shape right and left, since both sides of the inner wall are formed to have different inclinations. However, the inner guide 232 seems to be symmetrical right and left when viewed from the outside, since both sides of an outer wall of the inner guide 232 are formed to have the same inclination or similar inclinations. Thus, the inner guide 232 can provide a user with a sense of stability due to a symmetric shape right and left, such as the conventional discharge guide unit, as well as a scattering preventing effect.

A distance from a central axis of the inlet 231*a* to one side of the discharge opening 232*a* where the scattering preventing unit 230*a* is formed, is shorter than a distance from the central axis of the inlet 231*a* to another side of the discharge opening 232*a*. Thus, crushed ice, which is moved in a biased manner to one side based on the central axis of the inlet 231*a*, may be prevented from scattering, by the scattering preventing unit 230*a*.

As aforementioned, the inner guide 232 may be formed to have an arc shape that its rear side where the manipulation lever 240 is disposed is open. In the drawings, the inner guide 232 is positioned such that its both ends correspond to both sides of the manipulation lever 240.

In this embodiment, if one end of the inner guide 232 where the scattering preventing unit 230*a* is formed has a larger thickness than another end, interference may occur between the one end and the manipulation lever 240. For prevention of such interference, the one end may have a tapered portion 230*a*' formed to be distant from the manipulation lever 240.

Hereinafter, a discharge guide unit according to another embodiment, which is applicable to the ice supplying apparatus of the present invention, will be explained.

Figure 9:
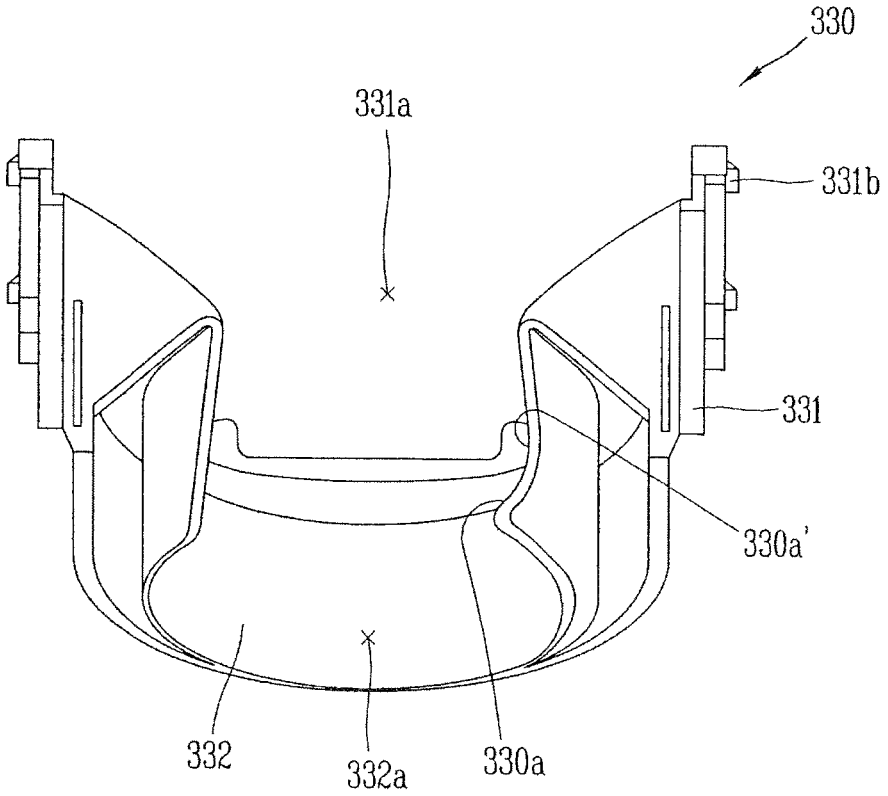
FIG. 9 is a conceptual view illustrating a discharge guide unit according to another embodiment of the present invention.

FIG. 9 is a conceptual view illustrating a discharge guide unit 330 according to another embodiment of the present invention.

Referring to FIG. 9, the discharge guide unit 330 includes a guide body 331 and an inner guide 332. The guide body 331 is provided with hooks 331*b* protruding from a plurality of regions on an edge of the guide body 331. One side of an inner wall of an inner guide 332 is bent and extended toward the inside of the inner guide 332 on at least one point, thereby forming a scattering preventing unit 330*a*.

More specifically, the one side of the inner wall of the inner guide 332 extends from the upper side where it is communicated with an inlet 331*a*, with an inclination similar to or the same as that of another side of the inner wall. Then, the one side of the inner wall of the inner guide 332 is bent toward the inside on one point, thereby extending to the lower side, a discharge opening 332*a*. As the bent and extending part has a different inclination from another side of the inner wall, the scattering preventing unit 330*a*, configured to prevent crushed ice from scattering when the crushed ice is discharged, is implemented. Both side walls of the inner guide 332 may have the same thickness.

With such a structure, crushed ice may be laminated on a bent portion 330*a*'. For prevention of this, the bent portion 330*a*' is preferably formed to be rounded such that different inclinations on both sides thereof are smoothly connected to each other.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An ice supplying apparatus, comprising:

an ice bank configured to store ice made by an ice maker;

a blade unit having a fixed blade and a rotary blade, the rotary blade being configured to rotate about a rotation axis with respect to the fixed blade and being configured to, based on rotation of the rotary blade in a first direction, cause ice stored in the ice bank to be crushed between the rotary blade and the fixed blade;

a discharge guide located below the blade unit and configured to guide discharge of the crushed ice, the discharge guide having a first side and a second side that is opposite to the first side with respect to an axis that extends from the rotation axis in a direction of gravity; and an ice duct located between the ice bank and the discharge guide and configured to guide the crushed ice to the discharge guide, wherein the discharge guide includes:

a first portion that is located at the first side of the discharge guide and that is configured to, during discharge of the crushed ice, reduce scattering of the crushed ice from the discharge guide, the first portion having a first surface that extends downward and toward the axis and that defines a first angle with respect to the axis, and a second portion that is located at the second side of the discharge guide, the second portion having a second surface that extends downward and that defines a second angle with respect to the axis, the first angle being greater than the second angle, wherein the fixed blade is located at a side corresponding to the second side of the discharge guide opposite to the first portion of the discharge guide with respect to the axis, wherein the axis penetrates an inner space of the ice duct and an inner space of the discharge guide, wherein the rotary blade is configured to, based on rotating in the first direction, pass the axis and approach from the axis toward the first portion located at the first side of the discharge guide, wherein the first portion is positioned in an area defined by a tangential vector and a normal vector that extend from a lowest point of a circle that is defined by rotation of the rotary blade as the rotary blade rotates in the first direction, wherein the discharge guide includes:

a guide body installed at a dispenser case, the guide body defining an inlet through which the crushed ice is introduced, and an inner guide that is located in the guide body and that is configured to guide discharge of the crushed ice, the inner guide defining a discharge outlet for discharge of the crushed ice, wherein the inner guide includes the first portion, and wherein a part of an inner wall of the inner guide defines the first surface of the first portion.

2. The ice supplying apparatus of claim 1, wherein the fixed blade is located between the axis and the second portion of the discharge guide.

3. The ice supplying apparatus of claim 1, wherein an outer wall of the inner guide is spaced a part from an inner surface of the guide body.

4. The ice supplying apparatus of claim 1, wherein the second portion of the discharge guide is a part of the inner guide.

5. The ice supplying apparatus of claim 1, wherein another part of the inner wall of the inner guide defines the second surface of the second portion.

6. The ice supplying apparatus of claim 1, wherein the fixed blade and the rotary blade each have a knife edge configured to crush ice located at one side, and wherein the knife edge of the rotary blade is configured to, based on rotation of the rotary blade in the first direction, rotate toward the knife edge of the fixed blade and crush ice disposed between the rotary blade and the fixed blade, and wherein the rotary blade has a smooth side that is configured to, based on rotation of the rotary blade in a second direction that is opposite of the first direction, push ice to bypass the fixed blade and dispense the ice as ice cubes.

7. The ice supplying apparatus of claim 1, wherein a thickness of the first portion increases toward an inside of the inner guide as the first portion extends toward the discharge outlet.

8. The ice supplying apparatus of claim 1, wherein the first portion and the second portion of the discharge guide extend downward from the inlet to the discharge outlet, and wherein a horizontal distance between the first portion and the axis is less than a horizontal distance between the second portion and the axis.

9. The ice supplying apparatus of claim 1, wherein the first portion is bent from the inner wall of the inner guide and extends toward an inside of the inner guide.

10. The ice supplying apparatus of claim 9, wherein both side walls of the inner guide corresponding to the first portion and the second portion, respectively, have a same thickness.

11. The ice supplying apparatus of claim 1, further comprising a manipulation lever configured to generate a control signal for dispensing ice based on being pressed, wherein the inner guide has an arc shape, and wherein the inner guide has a first end positioned at a first side of the manipulation lever, and a second end positioned at a second side of the manipulation lever that is opposite of the first side of the manipulation lever.

12. The ice supplying apparatus of claim 11, wherein the first portion that has a thickness increasing toward an inside of the inner guide, and wherein the thickness of the first portion of the inner guide increases toward the first end of the inner guide from a point between the first and second ends of the inner guide.

13. The ice supplying apparatus of claim 12, wherein the first end of the inner guide has a tapered portion that is spaced apart from the manipulation lever.

14. A refrigerator, comprising:

a refrigerator body;

a refrigerator door rotatably connected to the refrigerator body; and an ice supplying apparatus installed at the refrigerator door, the ice supplying apparatus comprising:

an ice bank configured to store ice made by an ice maker;

a blade unit having a fixed blade and a rotary blade, the rotary blade being configured to rotate about a rotation axis with respect to the fixed blade and being configured to, based on rotation of the rotary blade in a first direction, cause ice stored in the ice bank to be crushed between the rotary blade and the fixed blade;

a discharge guide located below the blade unit and configured to guide discharge of the crushed ice, the discharge guide having a first side and a second side that is opposite to the first side with respect to an axis that extends from the rotation axis in a direction of gravity; and an ice duct located between the ice bank and the discharge guide and configured to guide the crushed ice to the discharge guide, wherein the discharge guide includes:

a first portion that is located at the first side of the discharge guide and that is configured to, during discharge of the crushed ice, reduce scattering of the crushed ice from the discharge guide, the first portion having a first surface that extends downward and toward the axis and that defines a first angle with respect to the axis, and a second portion that is located at the second side of the discharge guide, the second portion having a second surface that extends downward and that defines a second angle with respect to the axis, the first angle being greater than the second angle, wherein the fixed blade is located at a side corresponding to the second side of the discharge guide opposite to the first portion of the discharge guide with respect to the axis, wherein the axis penetrates an inner space of the ice duct and an inner space of the discharge guide, wherein the rotary blade is configured to, based on rotating in the first direction, pass the axis and approach from the axis toward the first portion located at the first side of the discharge guide, wherein the first portion is positioned in an area defined by a tangential vector and a normal vector that extend from a lowest point of a circle that is defined by rotation of the rotary blade as the rotary blade rotates in the first direction, wherein the discharge guide includes:

a guide body installed at a dispenser case, the guide body defining an inlet through which the crushed ice is introduced, and an inner guide that is located in the guide body and that is configured to guide discharge of the crushed ice, the inner guide defining a discharge outlet for discharge of the crushed ice, wherein the inner guide includes the first portion, and wherein a part of an inner wall of the inner guide defines the first surface of the first portion.

15. The refrigerator of claim 14, wherein the first portion extends toward the discharge outlet, a thickness of the first portion increasing toward an inside of the inner guide as the first portion extends toward the discharge outlet.

16. The refrigerator of claim 14, wherein the ice supplying apparatus further comprises a manipulation lever configured to generate a control signal for dispensing ice based on being pressed, wherein the inner guide has an arc shape, and wherein the inner guide has a first end positioned at a first side of the manipulation lever, and a second end positioned at a second side of the manipulation lever that is opposite of the first side of the manipulation lever.

17. The refrigerator of claim 16, wherein a thickness of the first portion increases toward an inside of the inner guide, and wherein the thickness of the first portion increases toward the first end of the inner guide from a point between the first and second ends of the inner guide.

* * * * *